US011530123B2

(12) United States Patent
Hamlik et al.

(10) Patent No.: US 11,530,123 B2
(45) Date of Patent: Dec. 20, 2022

(54) LIFT TRUCK ATTACHMENT WITH SMART CLAMP

(71) Applicant: Rightline Equipment, Inc., Rainier, OR (US)

(72) Inventors: Jim D. Hamlik, Vancouver, WA (US); Joel D. Hamlik, Vancouver, WA (US); Hunter Wickert, Vancouver, WA (US)

( * ) Notice: Subject to any disclaimer, the term of this patent is extended or adjusted under 35 U.S.C. 154(b) by 0 days.

(21) Appl. No.: 17/413,869

(22) PCT Filed: Dec. 20, 2019

(86) PCT No.: PCT/US2019/068163

§ 371 (c)(1),
(2) Date: Jun. 14, 2021

(87) PCT Pub. No.: WO2020/132643

PCT Pub. Date: Jun. 25, 2020

(65) Prior Publication Data

US 2022/0063973 A1 Mar. 3, 2022

Related U.S. Application Data

(60) Provisional application No. 62/830,535, filed on Apr. 7, 2019, provisional application No. 62/784,363, filed on Dec. 21, 2018.

(51) Int. Cl.
*B66F 9/18* (2006.01)
*B66F 9/075* (2006.01)

(52) U.S. Cl.
CPC ..... *B66F 9/183* (2013.01); *B66F 9/0755* (2013.01)

(58) Field of Classification Search
CPC ..... B66F 9/183
See application file for complete search history.

(56) References Cited

U.S. PATENT DOCUMENTS

| | | | | |
|---|---|---|---|---|
| 6,027,302 | A * | 2/2000 | Nilsson | B66F 9/184 294/907 |
| 7,018,159 | B2 * | 3/2006 | Jordan | B25J 13/082 294/907 |
| 8,078,315 | B2 * | 12/2011 | McKernan | B66F 9/22 701/1 |
| 9,114,963 | B2 * | 8/2015 | McKernan | B66F 9/0755 |
| 10,597,272 | B2 * | 3/2020 | Chase | B66F 9/183 |
| 11,136,229 | B2 * | 10/2021 | Walthers | F15B 11/028 |
| 2014/0244025 | A1 * | 8/2014 | McKernan | B66F 9/22 700/213 |
| 2021/0102836 | A1 * | 4/2021 | Petronek | B66F 9/22 |
| 2021/0395061 | A1 * | 12/2021 | Walthers | F15B 3/00 |

* cited by examiner

*Primary Examiner* — Mark C Hageman
(74) *Attorney, Agent, or Firm* — Rylander & Associates, PC; Philip R. M. Hunt

(57) ABSTRACT

A smart clamp load handler system configured for controlling a clamp and preventing over-clamping. The system having a first actuator coupled to a first clamp arm and a second actuator coupled to a second clamp arm, an actuator control valve configured to control flow of hydraulic fluid to the actuators, and an electrical controller configured for signaling the actuator control valve when compressing a load. In one embodiment, the electrical controller is configured for determining when to stop the closing of the clamp arms based on a series of first and second actuator position measurements, and a series of base-side and rod-side pressure measurements, then signaling the actuator control valve to stop the closing of the clamp arms.

20 Claims, 12 Drawing Sheets

LIFT TRUCK ATTACHMENT WITH SMART CLAMP

CROSS-REFERENCE TO RELATED APPLICATIONS

This application is a National Stage Entry under 35 U.S.C. 371 of International Application PCT/US19/68163, filed 2019 Dec. 20, which claims the benefit of U.S. Provisional Application No. 62/784,363, filed 2018 Dec. 21, and U.S. Provisional Application No. 62/830,535, filed 2019 Apr. 7, all incorporated herein by reference.

FIELD OF THE INVENTION

The present invention relates to cargo handling equipment. More particularly, the present invention relates to load clamps for use primarily with lift trucks.

BACKGROUND

Material handling vehicles such as lift trucks are used to pick up and deliver loads between stations. A typical lift truck 10 has a mast 12, which supports a carriage 14 that can be raised along the mast 12 (see FIG. 1). The carriage 14 typically has one or more carriage bars 16 to which a fork frame 18 is mounted. The carriage bars 16 are coupled to the mast in a way that allows the lift truck 10 to move the carriage bars 16 up and down, but not laterally relative to the truck. The fork frame 18 carries a pair of forks 20. An operator of the lift truck 10 maneuvers the forks 20 beneath a load prior to lifting it.

Instead of forks 20, a lift truck 10 may have other kinds of attachments coupled to its mast 12. One type of attachment is a clamp load handler 32 (See FIG. 2). The clamp load handler 32 typically comprises a frame 40, one or more actuators 36 and two clamp arms 34. The actuators 36 are configured to move the clamp arms 34 toward or away from each other with actuator rods 38. The clamp arms 34 typically have a gripping material on the inside surfaces that contact the load. The gripping material, such as rubber or polyurethane, provides high friction contact surface for gripping the load and also provides a compressible and resilient contact surface to protect the load from superficial damage from the clamp arms 34. In use, the operator of the lift truck 10 approaches a load to be carried, such as a stack of cartons or a large appliance, such as a refrigerator. As the lift truck 10 approaches the load, the operator uses controls to open the gap between the clamp arms 34 wider than the load and may adjust the height of the clamp arms 34 so they will engage the load in a suitable location. The operator then maneuvers the lift truck 10 to straddle the load between the clamp arms 34. When the clamp arms 34 are positioned suitably around the load, the operator uses controls to bring the clamp arms 34 together, grasping the load. The operator then uses other controls to raise the load clamp assembly 22, raising the load off the floor, the load held between the clamp arms 34 by friction. The operator then drives the load to a desired location. The amount of force the clamp arms 34 apply must be "just right." Too little force and the load may slip out for the clamp arms 34, which can be disastrous, particularly when the lift truck 10 is moving. Too much force can crush the load. With only manual control of the clamp arms 34, applying just the right amount of force is completely dependent on the lift truck operator. Even a skilled operator's ability to apply just the right amount of force is limited because they cannot feel the amount of force being applied and must rely on visual and audio indications of how much force is being applied.

BRIEF DESCRIPTION OF THE DRAWINGS

The present invention will be described by way of representative embodiments, illustrated in the accompanying drawings in which like references denote similar elements, and in which.

DETAILED DESCRIPTION

Before beginning a detailed description of the subject invention, mention of the following is in order. When appropriate, like reference materials and characters are used to designate identical, corresponding, or similar components in different figures. The figures associated with this disclosure typically are not drawn with dimensional accuracy to scale, i.e., such drawings have been drafted with a focus on clarity of viewing and understanding rather than dimensional accuracy.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Use of directional terms such as "upper," "lower," "above," "below", "in front of," "behind," etc. are intended to describe the positions and/or orientations of various components of the invention relative to one another as shown in the various figures and are not intended to impose limitations on any position and/or orientation of any embodiment of the invention relative to any reference point external to the reference. Herein, "left" and "right" are from the perspective of an operator seated in a lift truck facing the carriage of the lift truck. Herein, "lateral" refers to directions to the left or the right and "longitudinal" refers to a direction perpendicular to the lateral direction and to a plane defined by the carriage.

Those skilled in the art will recognize that numerous modifications and changes may be made to the various embodiments without departing from the scope of the claimed invention. It will, of course, be understood that modifications of the invention, in its various aspects, will be apparent to those skilled in the art, some being apparent only after study, others being matters of routine mechanical, chemical and electronic design. No single feature, function or property of the first embodiment is essential. Other embodiments are possible, their specific designs depending upon the particular application. As such, the scope of the invention should not be limited by the particular embodiments herein described but should be defined only by the appended claims and equivalents thereof.

REPRESENTATIVE EMBODIMENT—STRUCTURE

Figure 1:
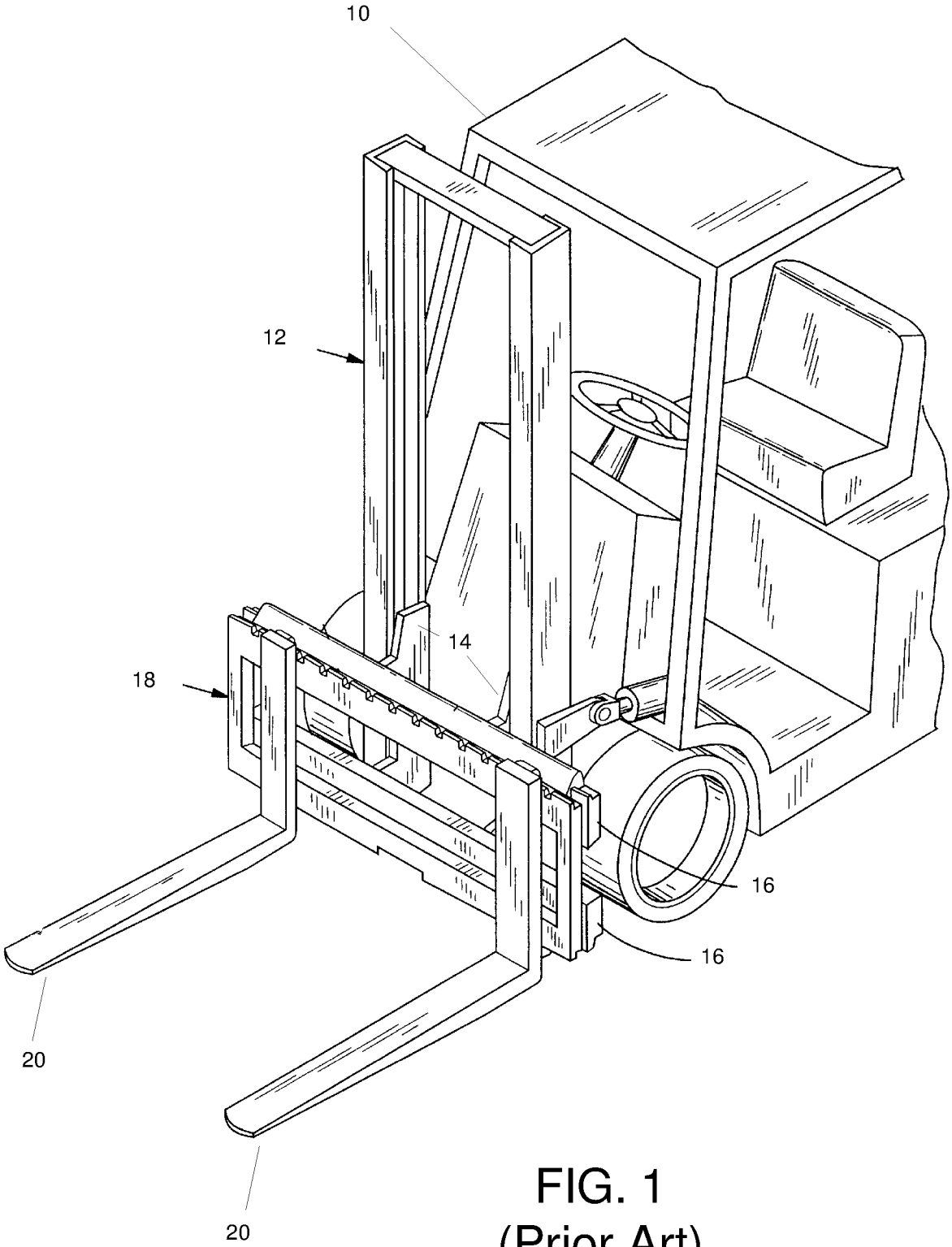
FIG. 1 (Prior Art)
FIG. 1 is an isometric view of a prior art lift truck, illustrating typical components of a lift truck equipped with forks.
Figure 2:
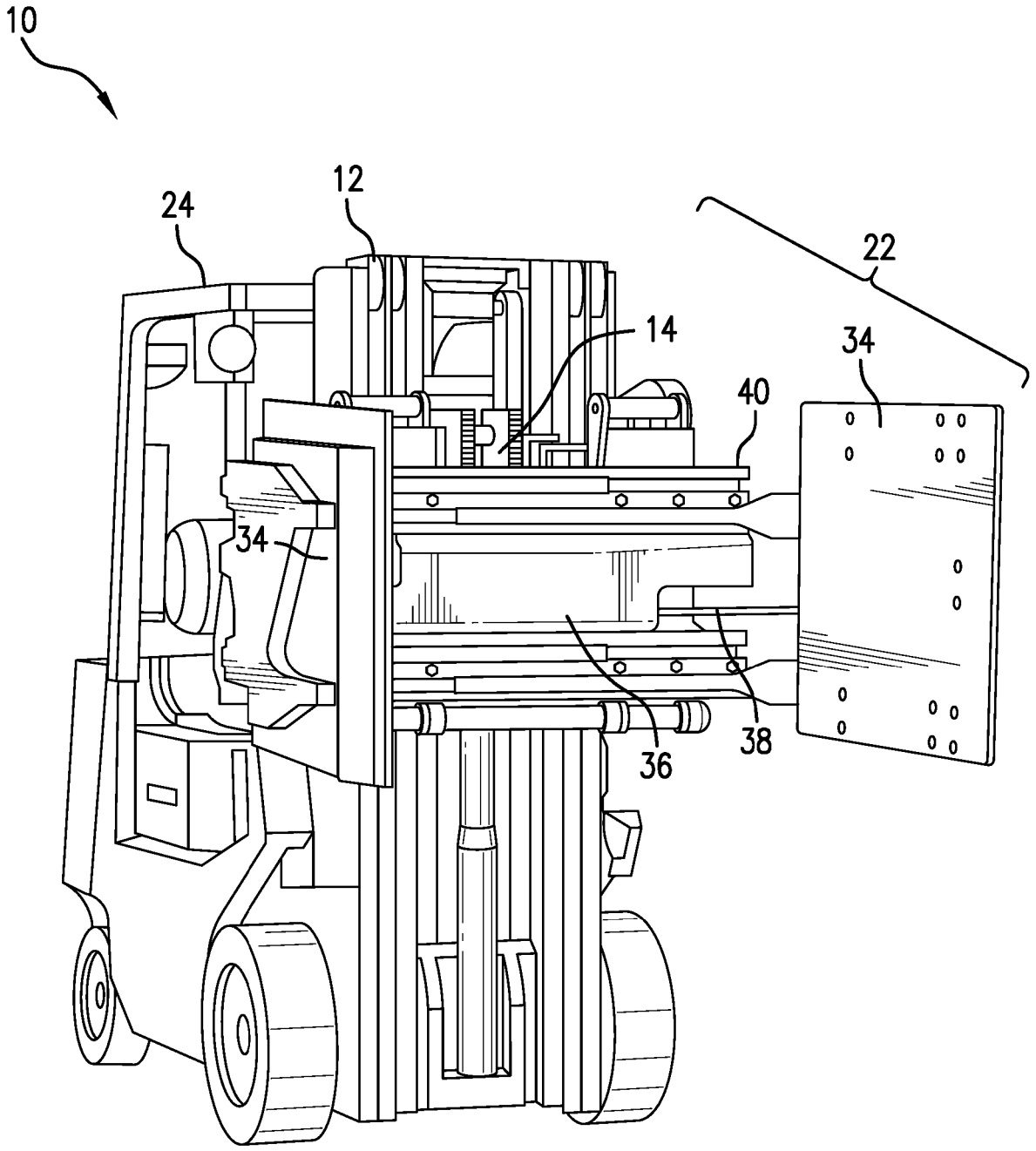
FIG.2 (Prior Art)
FIG. 2 is an isometric view of a prior art lift truck, illustrating typical components of a lift truck equipped with a load clamp assembly.
Figure 3:
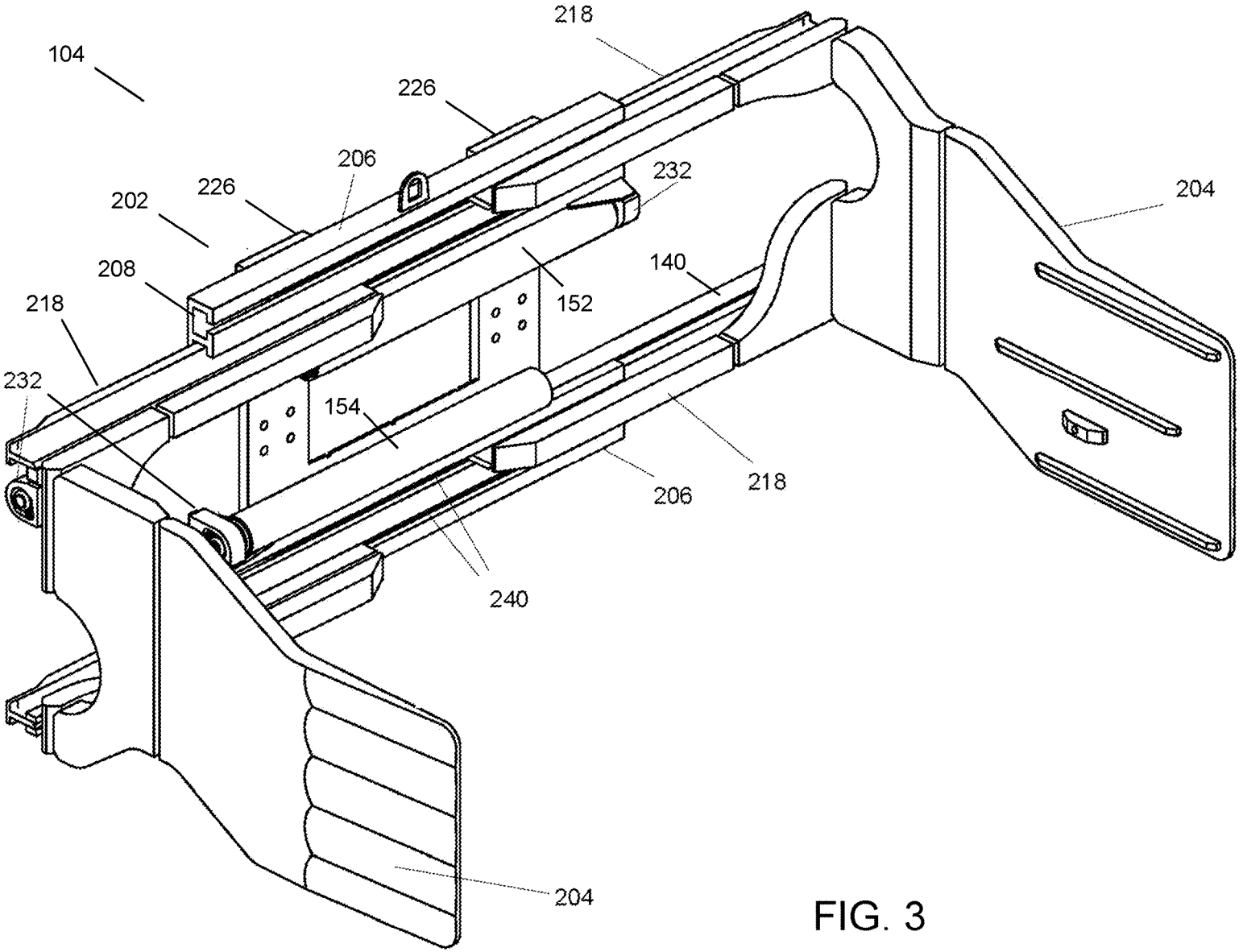
FIG. 3 shows a perspective view of the main structural components of a first representative embodiment smart clamp load handler (hydraulic lines and electrical controls not shown).

FIG. 3 shows a perspective view of the main structural components of a first representative embodiment smart clamp load handler 104 (hydraulic lines, electrical sensors and electrical controls not shown). The smart clamp load handler 104 comprises a frame 202, a pair of clamp arms 204, 205 coupled to the frame 202 and a pair of clamp actuators 152, 154. A left clamp actuator 152 is coupled to a left clamp arm 204 and a right clamp actuator 154 coupled to a right clamp arm 205. The clamp actuators 152, 154 are configured to pull the clamp arms 204, 205 together or push them apart.

The frame 202 is configured to be coupled to a carriage 14 of a lift truck 10. The frame 202 comprises two frame vertical beams 226 with four guide channels 206 coupled thereto. Two guide channels 206 are positioned near a top of the frame 202 and two guide channel 206 positioned near a bottom of the frame 202. In the first representative embodiment smart clamp load handler 104, the upper two guide channels 206 share a common channel wall and the lower two guide channels 206 are similar. However, in other embodiments, the guide channels 206 do not necessarily have common walls with adjacent guide channels 206, the frame 202 may have more or fewer guide channels 206 and the guide channels may be arranged differently.

Each of the guide channels 206 has a guide channel cavity 208. The guide channels 206 each have a guide channel slot 248 on the front, opening to the guide channel cavity 208. Each guide channel 206 has a channel bearing, positioned inside the guide channel cavity 208 and shaped to conform to thereto, and with its own interior cavity that is similarly shaped, but slightly smaller. The channel bearing is detachably coupled to the guide channel 206. The channel bearings are made of suitable bearing material that provides low friction and is softer than the components it has sliding contact with in order to preferentially wear. Since the channel bearings are removable, they can be easily replaced when worn down.

Each clamp arm 204 has two clamp sliding beams 218 coupled thereto. The two clamp sliding beams 118 are configured to slidingly fit into two of the guide channels 206 of the frame 202. More specifically, the clamp sliding beams 118 insert into the channel bearings of the guide channels 206 with a sliding fit. In the representative embodiment, the portion of each clamp sliding beam 118 inserted into the guide channel 206 has a "T" cross-section, with the top of the "T" held inside the guide channel 206 and the base of the "T" extending out of the guide channel slot 248. However, in other embodiments, the guide channel 206 and the clamp sliding beam 118 may have other suitable cross-sectional shapes.

Two actuator brackets 232 are coupled to the frame 202, one coupled to a bottom of a lower of the top two guide channels 206, and the other coupled to a top of an upper of the bottom two guide channels 206. The upper actuator bracket 232 is position on the left of the frame 202 and the lower actuator bracket 232 is located on the right of the frame 202, when viewed from the lift truck 10. Each of the clamp actuators 152, 154 is coupled to the frame 202 via one of the actuator brackets 232. Each clamp actuators 152, 154 has an actuator rod 140 that is coupled to an actuator bracket 232 on one of the clamp arms 204.

FIGS. 4A-4D each show a schematic view of a first representative embodiment of a smart clamp system 100, each in a different phase of operation for clamp and unclamping a load 50. The schematic is divided with truck side 102 components of the smart clamp system 100 on the left and load-handler side 103 components on the right. A clamp hydraulic feed line 144 and a clamp hydraulic return line 146 cross over from the truck side 102 to the load handling side 103 via flexible connections that have sufficient slack to handle the relative motion between the smart clamp load handler 104 and the lift truck 10. The smart clamp system has a control console 174 mounted on the lift truck 10.

On the load-handler side 103 of the schematic, the two clamp arms 204 and the associated clamp actuators 152, 154 from FIG. 3 are shown. The smart clamp load handler 104 also comprises a smart clamp control valve 130, a rod-side pressure sensor 132, a base-side pressure sensor 134, a left clamp actuator position sensor 176, a right clamp actuator position sensor 178, and an electrical controller 120. In other embodiments, the smart clamp control valve 130, the rod-side pressure sensor 132, the base-side pressure sensor 134 and/or the electrical controller 120 may be located on the truck side 102 of the smart clamp system 100.

On the truck side 102, the smart clamp system 100 has a hydraulic pump 106 to supply pressurized hydraulic fluid. The hydraulic pump 106 draws hydraulic fluid out of a hydraulic fluid reservoir 138. The hydraulic pump 106 is typically powered by the main engine of the lift truck 10 by belt or gear drives. The hydraulic pump 106 is typically a positive displacement pump. The outlet of the hydraulic pump 106 is connected to a relief valve 108 which regulates the pressure produced by the hydraulic pump 106 and provides a discharge path for excess hydraulic fluid that is not needed for the moment by the smart clamp system 100. The output of the hydraulic pump 106 couples to a truck hydraulic feed line 124. A truck hydraulic return line 126 brings hydraulic fluid back to the hydraulic fluid reservoir.

The smart clamp system 100 comprises a directional control valve 128 and a smart clamp control valve 130. The smart clamp control valve 130 is solenoid operated. The directional control valve 128 is manually operated, but in some embodiments the directional control valve 128 may be a solenoid operated valve. The directional control valve 128 controls the direction of hydraulic fluid flow, which determines whether the smart clamp actuators 160 move the clamp arms 204 to open or to close. The smart clamp control valve 130 is used to stop the clamping operation when the controller decides to do so based on its sensor input and algorithms. The directional control valve 128 is typically mounted to the lift truck 10 and the smart clamp control valve 130 is part of the smart clamp load handler 104. However, in some embodiments the directional control valve 128 may be part of the smart clamp load handler 104, in which case the truck hydraulic feed line 124 and truck hydraulic return line 126 have the flexible connections.

The directional control valve 128 is a three position, four port valve. When the directional control valve 128 is in a closed position, all four ports are blocked. When the directional control valve 128 is in a straight through position, a first input port of the directional control valve 128 (connected to the truck hydraulic feed line 124) is ported through a first output port to a clamp hydraulic feed line 144 that couples to a first input port of the smart clamp control valve 130, while a second input port of the directional control valve 128 (connected to the truck hydraulic return line 126) is ported through a second output port to a clamp hydraulic return line 146 that couples to a second input port of the smart clamp control valve 130. When the directional control valve 128 is in a cross-over position, the first input port of the directional control valve 128 is ported through the second output port to the clamp hydraulic return line 146 and the second input port is ported through the first output port to the clamp hydraulic feed line 144 that couples to the input port of the smart clamp control valve 130.

The smart clamp control valve 130 is a two position, four port valve with two input port and two output ports. When in a first position (flow unblocked), the smart clamp control valve 130 couples the first input port (connected to the clamp hydraulic feed line 144) with a first output port (connected to a main rod-side hydraulic line 148) and couples the second input port (connected to the clamp hydraulic return line 146) to the second output port (connected to main base-side hydraulic line 150). When in a second position (flow blocked), the smart clamp control valve 130 blocks the first input port with the first output port and couples the second input port to the second output port. In other embodiments, the smart clamp control valve 130 may be replaced by a single two port valve somewhere on the clamp hydraulic feed line 144 or a main rod-side hydraulic line 148, with the clamp hydraulic return line 146 connected directly to the main base-side hydraulic line 150.

The clamp actuators 152, 154 are hollow tubes with capped ends, each having an actuator piston 142 inside coupled to an actuator rod 140 that passes through a sealed opening in one of the capped ends. Each of the clamp actuators 152, 154 is thus divided by the actuator piston 142 into a rod-side on which the actuator rod 140 is coupled to the actuator piston 142 and a base-side opposite.

The main rod-side hydraulic line 148 splits into a left rod-side hydraulic line 180 and a right rod-side hydraulic line 182 (these three are collectively referred to as the "rod-side hydraulic lines"). The main base-side hydraulic line 150 splits into a left base-side hydraulic line 184 and a right base-side hydraulic line 186 (these three are collectively referred to as the "base-side hydraulic lines"). The left rod-side hydraulic line 180 hydraulically couples to the rod-side of the left clamp actuator 152, the right rod-side hydraulic line 182 hydraulically couples to the rod-side of the right clamp actuator 154, the left rod-side hydraulic line 180 hydraulically couples to the base-side of the left clamp actuator 152, and the right rod-side hydraulic line 182 hydraulically couples to the base-side of the right clamp actuator 154.

The rod-side pressure sensor 132 and the base-side pressure sensor 134 provide pressure measurements over control wiring 112 to the electrical controller 120 for use in controlling the smart clamp load handler 104. The rod-side pressure sensor 132 is hydraulically coupled to the main rod-side hydraulic line 148. In alternative embodiments, the rod-side pressure sensor 132 may be hydraulically coupled to another part of the rod-side hydraulic lines, such as the left rod-side hydraulic line 180 or the right rod-side hydraulic line 182. The base-side pressure sensor 134 is hydraulically coupled to the main base-side hydraulic line 150. In alternative embodiments, the base-side pressure sensor 134 may be hydraulically coupled to another part of the base-side hydraulic lines, such as the left base-side hydraulic line 184 or the right base-side hydraulic line 186.

In the representative embodiment, the pressure sensors 132, 134 are pressure transducers that outputs a 0-5 volt signal that is down converted in the electrical controller 120 to a 0-3.3V signal that is interpreted by an analog to digital converter in microcontroller in the electrical controller 120. Specifically, 0-3000 PSI (Hydraulic) translates to 0-5V transducer output, which is converted to 0-3.3V in the electrical controller 120, which is converted to 0-2048 points by the analog to digital converter, which is interpreted as 0-3000 PSI in the microcontroller of the electrical controller 120.

The left clamp actuator position sensor 176 and the right clamp actuator position sensor 178 provide measurements of the positions of the left clamp actuator 152 and right clamp actuator 154 over control wiring 112 to the electrical controller 120 for use in controlling the smart clamp load handler 104. In the representative embodiment, the position sensors 176, 178 are measuring wheel sensors, each comprising a wheel that is held against the clamp sliding beam 218 of the respective clamp arm 204, 205. On the back of this wheel there is a rotary encoder. The encoder sends a quadrature signal to the microcontroller that interprets this as a direction and distance at 400 tics per inch. The measuring wheel sensor does not measure position directly but does so indirectly based on a starting position and measurement of distance traveled. In other embodiments, the position sensors 176, 178 can be reel type distance measuring sensors that pay out or take in line as the respective clamp arm 204, 205 move out and in. In yet other embodiments, capacitive or inductive sensors may be used as position sensors 176, 178. In yet other embodiments, the left and right position sensors may be replaced with a single distance sensor that measures the distance between the clamp arms 304, 205.

The electrical controller 120 is configured with programming to control when to stop closing the clamp arms 204, 205. The electrical controller 120 programming is configured to change the smart clamp control valve 130 from the first position (flow through) to the second position (flow blocked) based on inputs from the pressure sensors 132, 134, and the clamp actuator position sensors 176, 178. In the representative embodiment, the electrical controller 120 comprises a micro-controller architecture, but in alternative embodiments, the electrical controller 120 may comprise hard-wired relay logic.

The control console 174 has an electronic graphical touch screen display that shows various information regarding operation of the smart clamp system 100, including pressure, clamp force, distance the clamps have moved, indication of when the load is clamped and when the load is over-clamped. In some embodiments, the electrical controller 120 has an electronic graphical touch screen display in addition or instead of the control console 174. The electronic graphical touch screen display is positioned to be visible to the operator when the smart clamp load handler 104 is at ground level or raised by the lift truck mast 12. In some embodiments the electronic graphical touch screen display is physically separate from, but communicatively coupled with the electrical controller 120 and relocatable on the smart clamp load handler 104 to ensure visibility.

REPRESENTATIVE EMBODIMENT—THEORY OF OPERATION

The programming of the electrical controller 120 used to control when to stop closing the clamp arms 204, 205 is based on and observed relationship between the force applied by the clamp arms 204, 205 and the amount of strain experienced by the load 50. Load strain is measured by distance the clamp arms 204, 205 have moved towards each other after contacting the load 50. The force applied ($F_A$) by the clamp arms 204, 205 when moving towards each other is determined by taking the hydraulic pressure as measured by the rod-side pressure sensor 132, then multiplying by the known area of the actuator pistons 142 less the area of the actuator rods 140 then subtracting the back-pressure force on the actuator pistons 142. The back-pressure force on the actuator pistons is determined by taking the hydraulic pressure as measured by the base-side pressure sensor 134, then multiplying by the known area of the actuator pistons 142. Force applied=(Rod-side pressure*(Piston area−Rod area))−(Base-side pressure*Piston area). In other embodiments, friction force is subtracted from force applied as well. The friction force for a certain speed can be determined in a calibration test by taking samples of the force applied when the clamp arms 204, 205 are freely moving at that speed, then subtracting back-pressure force. The speed of the clamp arms 204, 205 is calculated based on the time rate of change of the clamp arms 204, 205 positions as measured by the clamp actuator position sensors 176, 178. Running several calibration tests at different speeds develops a set of friction forces at various speed. This friction force data can be used in operation by an algorithm that takes current speed based on data from the clamp actuator position sensors 176, 178 to determine the current friction force. The current friction force could then be subtracted as well when determining the force applied by the clamp arms 204, 205. Force applied=(Rod-side pressure*(Piston area−Rod area))−(Base-side pressure*Piston area)−Friction Force.

Figure 5:
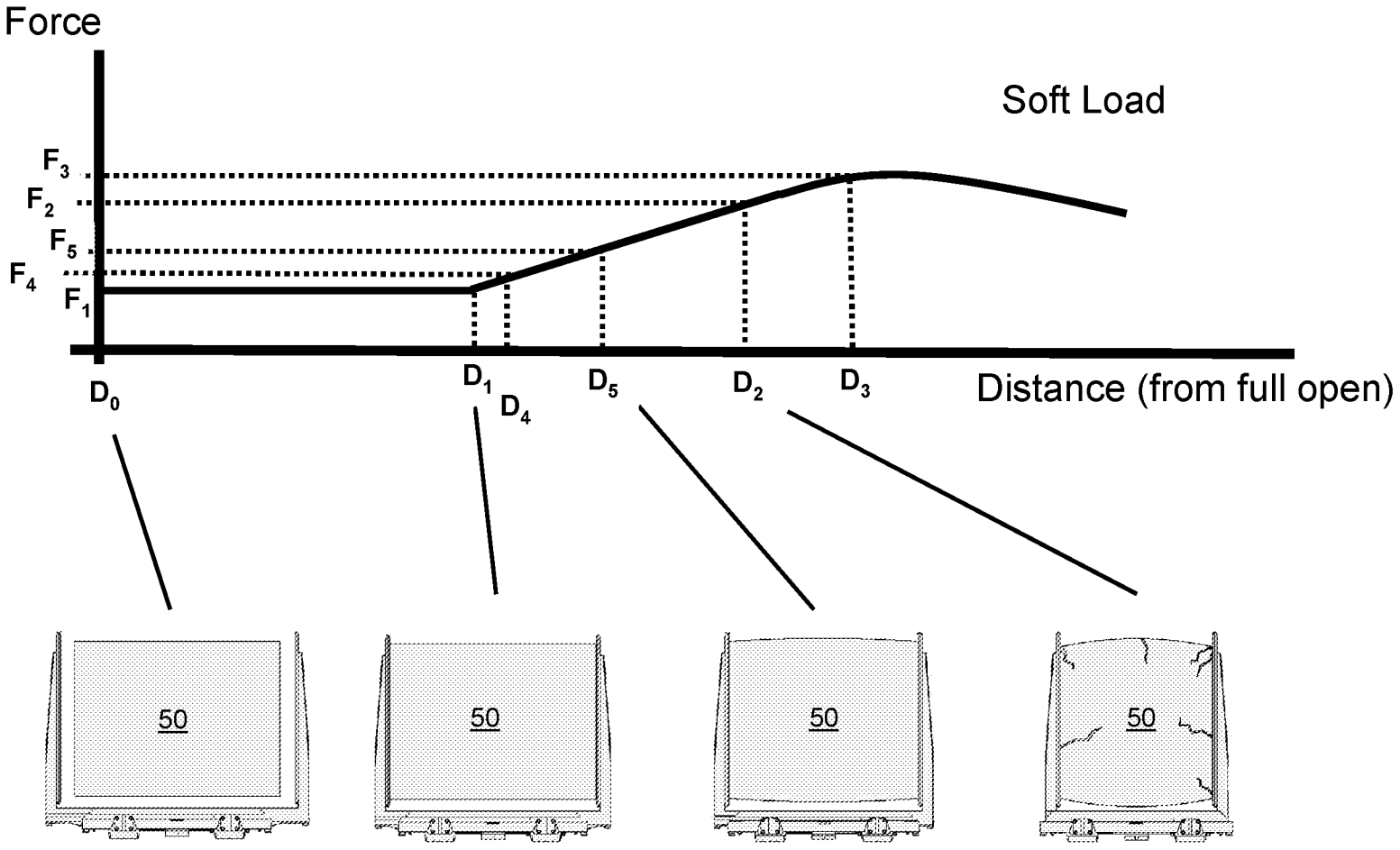
FIG. 5 shows a graph of the force applied to the clamp actuators vs the distance the clamp arms have moved towards each other, as well as cross-sectional views of the clamp arms and the load at key points.

The distance the clamp arms 204, 205 have moved towards each other is measured by the clamp actuator position sensors 176, 178. FIG. 5 shows a graph of F (the force applied to the clamp actuators 152, 154) vs D (the distance the clamp arms 204, 205 have moved towards each other). At distance Do, the fully open position of the clamp arms 204, 205, a force $F_1$ is applied to the clamp actuators 152, 154. The force applied effectively remains constant (F v D slope~0) at $F_1$ as the clamp arms 204, 205 converge since the force applied by the net hydraulic pressure is balanced by friction forces. When the clamp arms 204, 205 have converged by distance $D_1$, they contact the load 50. If the load 50 is elastic, the force applied rises as the load 50 provides increasing counter force as it is compressed and undergoes elastic (reversable) deformation. At least initially during elastic deformation, the force vs distance relationship is proportional and linear with a slope significantly more than zero. When the force increases to $F_2$, the proportionality limit is reached and the relationship between force and distance departs from linearity and its slope decreases. Some force above $F_2$, the elastic limit of the load 50 is reached and plastic (non-reversable) deformation begins, potentially damaging the load 50. When the force increases to $F_3$, the yield limit is reached and the load 50 can provide no additional counter force, so applied force at $F_3$ or above will likely destroy the load 50.

The relationship between F and D can be generated in real-time during the clamping process and used to determine when to stop moving the clamp arms 204, 205. An ideal stopping point is at least where the clamping is sufficient to lift and carry the load 50, but not to the point where there is likelihood of damage to the load 50. The $F_3/D_3$ yield limit point is too late to avoid damage to the load 50. The $F_1/D_1$ point of first contact will be insufficient to lift and carry the load 50 as $F_1$ will not likely apply sufficient force to the load 50 to generate sufficient friction force to counter the weight of the load 50, unless the load 50 is light enough and has a sufficiently rough surface. Somewhere before $F_2/D_2$ point (proportionality limit) is a good place to stop the clamping since significant force has been applied that will be sufficient to lift and carry the load 50, but not likely enough force to damage it.

To determine when clamping is to be stopped, the electrical controller 120 receives and records in real-time sets of F/D data for the force applied F and distance converged D. Sets of F/D data are recorded at sufficiently frequent distance intervals. In the representative embodiment 100-400 sets of F/D data are recorded per inch. As new F/D data sets are recorded, a current slope based on the F/D data sets is calculated and updated with sufficient frequency. In the representative embodiment, for each new F/D data set, the slope between the new F/D data set and one or more of the previous F/D data sets is calculated and recorded as a slope data point associated with the new F/D data set. In the representative embodiment, the current slope is calculated based on the last F/D data set and the F/D data set that indicated the first point of contact between the clamp arms 204, 205 and the load 50, typically the F/D data set with a slope data point that is significantly greater than zero. In other embodiments, the current slope is calculated based on one or more of the recorded F/D data set slope data points.

Figure 6A:
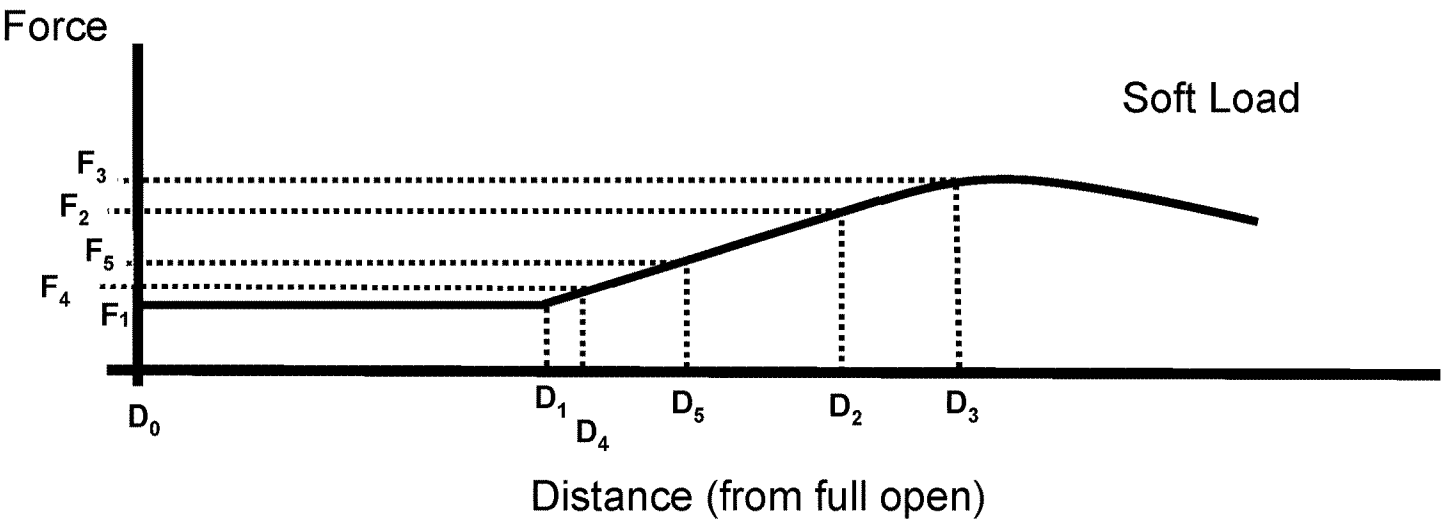
FIG. 6A shows a graph of the force applied to the clamp actuators vs the distance the clamp arms have moved towards each other for a soft load.
Figure 6B:
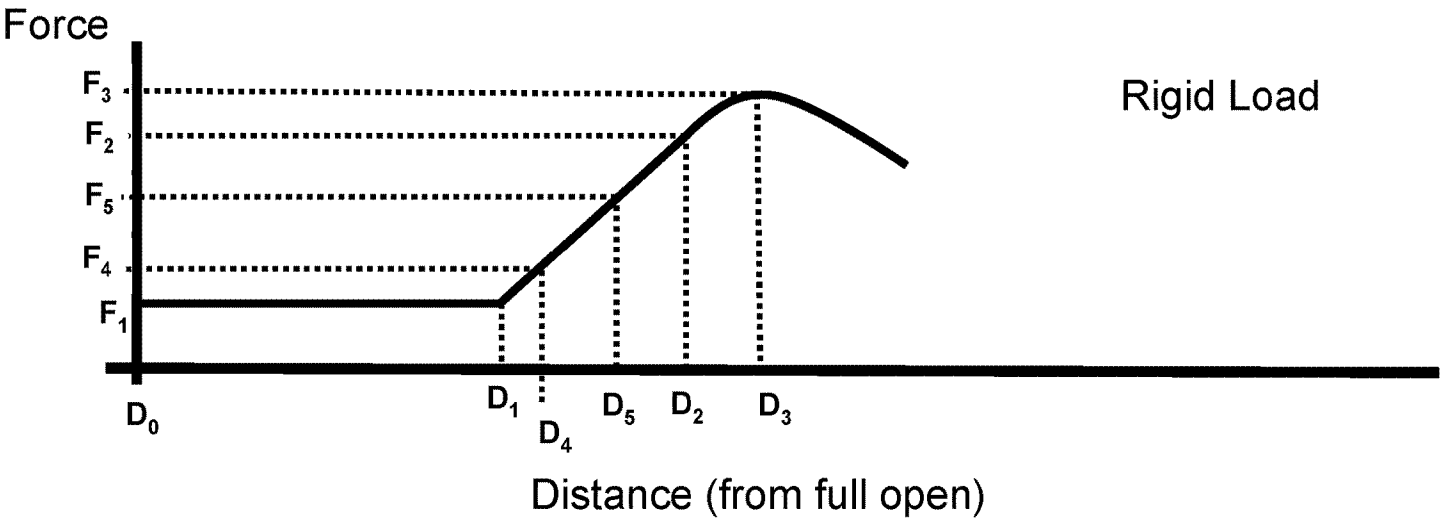
FIG. 6B shows a graph of the force applied to the clamp actuators vs the distance the clamp arms have moved towards each other for a rigid load.

In the representative embodiment, if the current slope remains greater than a threshold slope (700 pounds/inch in the representative embodiment), over a stabilization distance ($D_1$ to $D_4$ in FIGS. 5, 6A and 6B) (¼ inch or 100 data points in the representative embodiment), then a compression distance is calculated based on the current slope. A shown in FIG. 6, lower values for the current slope indicate a softer load and the calculation results in a longer compression distance ($D_4$ to $D_5$ in FIGS. 5 and 6A) (⅜ inch in the representative embodiment), but higher values for the current slop indicate a more rigid load and the calculation results in a shorter compression distance ($D_4$ to $D_5$ in FIG. 6B) (¼ inch in the representative embodiment). The clamping process is continued for the compression distance and the clamping process is stopped, typically by causing the smart clamp control valve 130 to shift to its flow-blocking position (second position). In some embodiments, the lift truck operator may adjust the threshold slope and other parameters through the control console 174 on the lift truck 10 that communicates with the electrical controller 120 via a wireless or wired communications link.

In some alternative embodiments, if the current slope remains greater than a threshold slope over a range of distance, the clamping process is stopped, typically by causing the smart clamp control valve 130 to shift to its flow-blocking position (second position). In some embodiments, the clamping process is allowed to continue (the smart clamp control valve 130 remains in the pass-through position (first position)) for a set compression distance before stopping.

Figure 7:
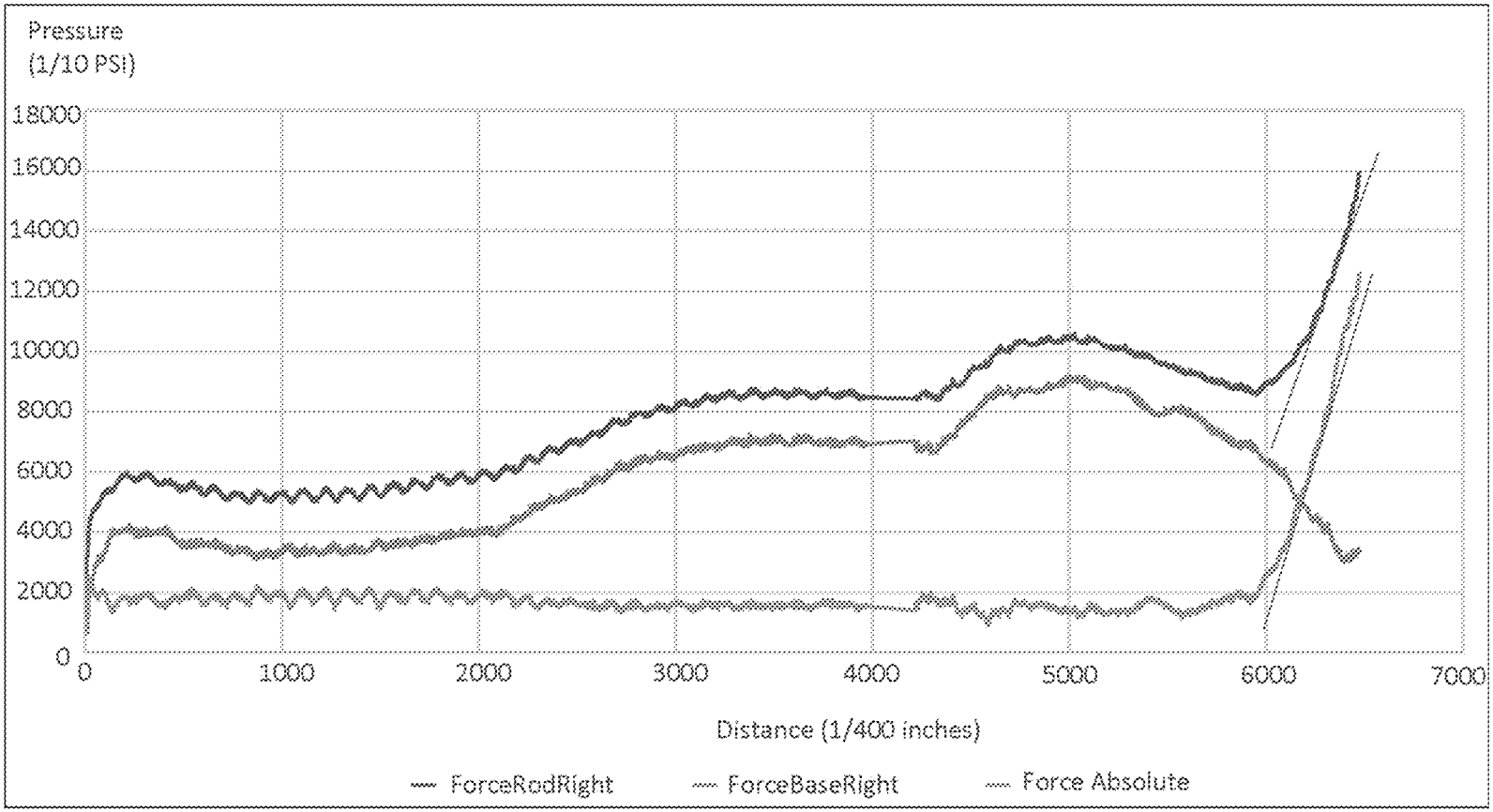
FIG. 7 shows a graph of pressure vs distance showing how using the difference between rod-side and base-side pressure measurements can eliminate unwanted transients.

The representative and alternative embodiments describe above are more tolerant to pressure surges in the hydraulic system than if pressure alone were used to stop the clamping process. Pressure surges from sticking bearings or the operator putting their foot on the accelerator petal will raise the pressure enough to prematurely end the clamping process. FIG. 7 shows a graph of pressure vs distance showing how using the difference between rod-side and base-side pressure measurements can eliminate unwanted transients. The upper trace is the pressure as measured by the rod-side pressure sensor 132. The middle trace is the pressure as measured by the base-side pressure sensor 134. The lower trace is the difference between the rod-side pressure and the base-side pressure. The lower axis is the distance the clamp arms 204, 205 have moved toward each other from a fully open position, based on measurements from the clamp actuator position sensors 176, 178. A surge in engine speed while the arms go from distance 4200 to 5800 results in the rod-side pressure surging, which could give a false indication of contact if it alone were relied on for that determination. However, the base-side pressure surges as well, cancelling out the pressure surge in rod-side so the difference trace shows no surge during the same distance interval. Similarly, a starting surge is observed in the rod-side and base-side traces as the clamp arms 204, 205 begin to move, haltingly at first, to overcome friction, but they cancel out and no starting surge is seen in the difference trace. When actual contact with the load 50 is made the slope of the difference line is greater than the slope of just the rod-side pressure, which gives a more positive sign that contact has been made. A good many other fluctuations in the rod-side and base-side traces cancel out and do not appear in the difference trace, making it much more suitable for detection of contact and detection of rigidity of the load 50.

REPRESENTATIVE EMBODIMENT—METHOD OF OPERATION

Figure 4A:
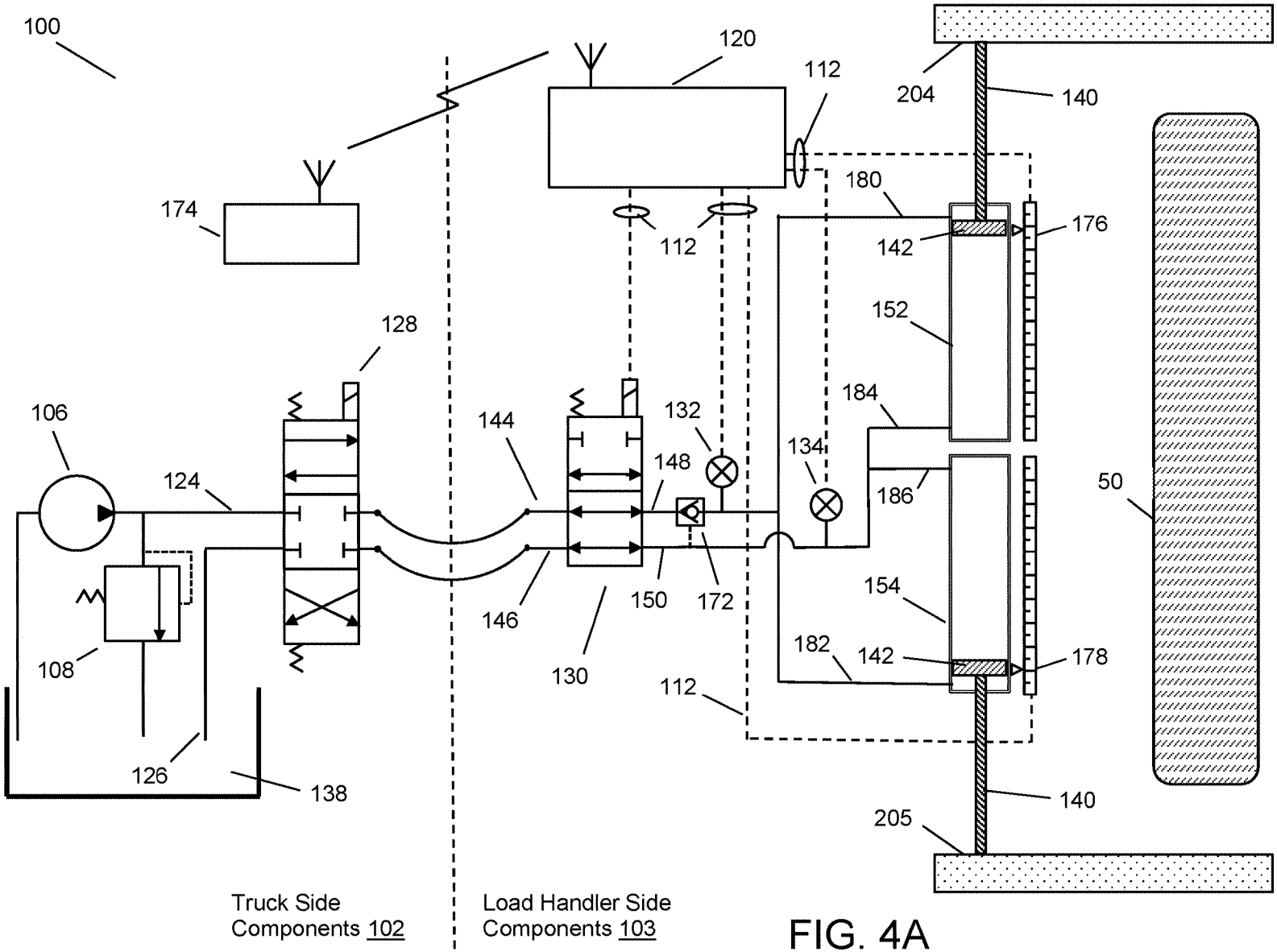
FIG. 4A shows a schematic of a first representative embodiment smart clamp system in a fully open phase of operation.
Figure 4B:
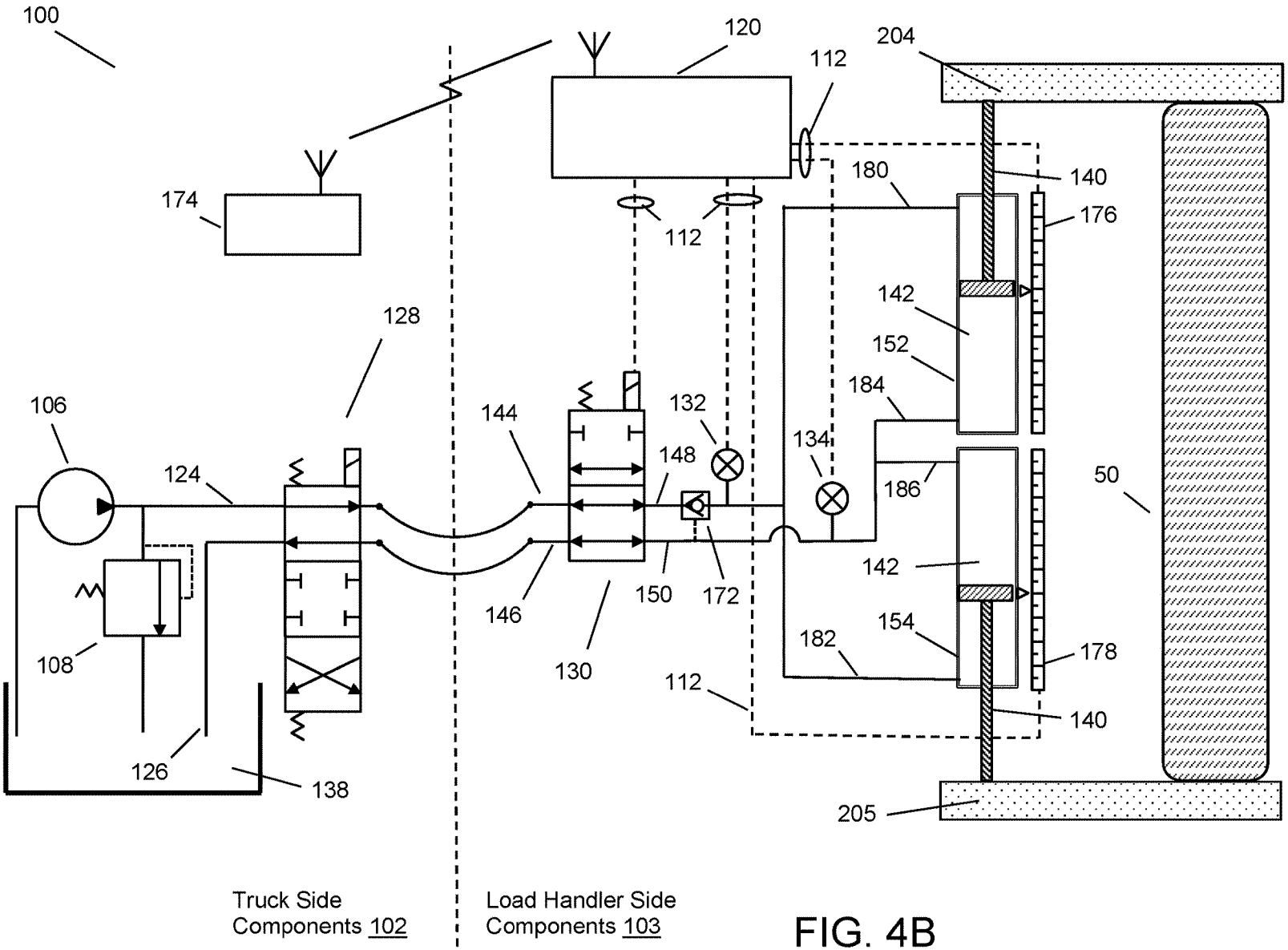
FIG. 4B shows a schematic of a first representative embodiment smart clamp system in a phase of operation where the clamp arms have just made contact with the load.
Figure 4C:
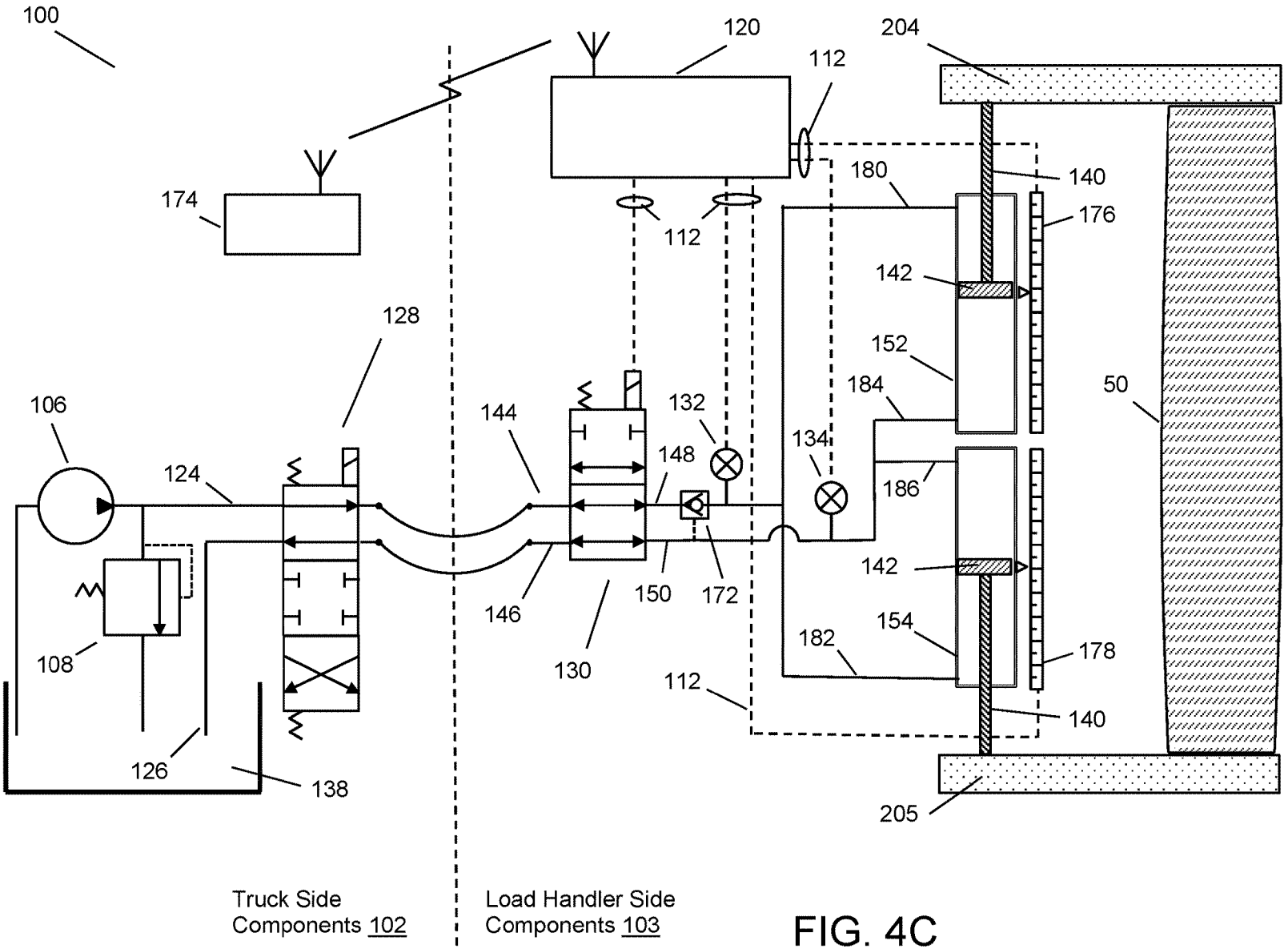
FIG. 4C shows a schematic of a first representative embodiment smart clamp system in a phase of operation where the clamp arms have just begun to compress the load.
Figure 4D:
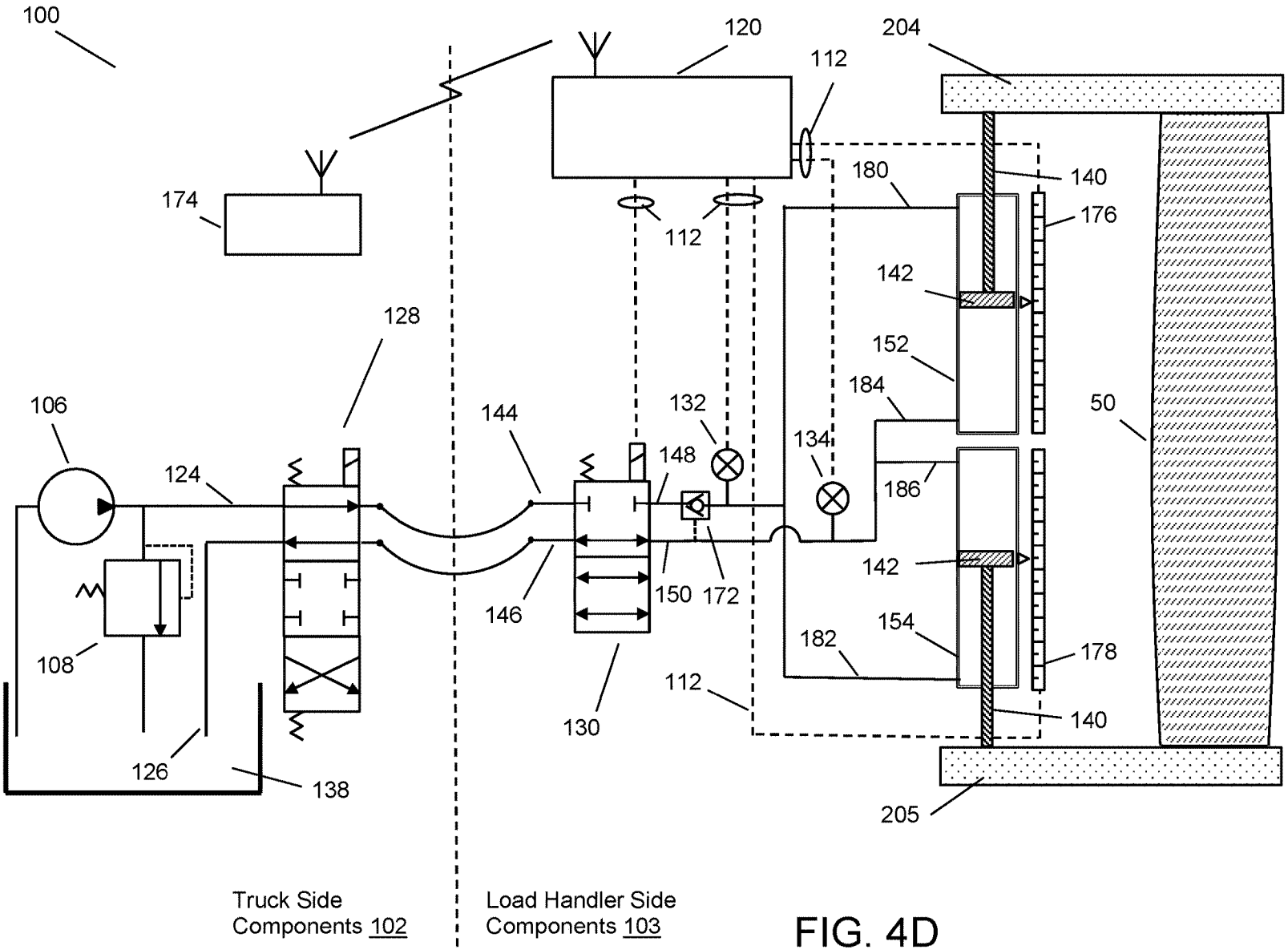
FIG. 4D shows a schematic of a first representative embodiment smart clamp system in a phase of operation where clamping process has stopped.
Figure 8A:
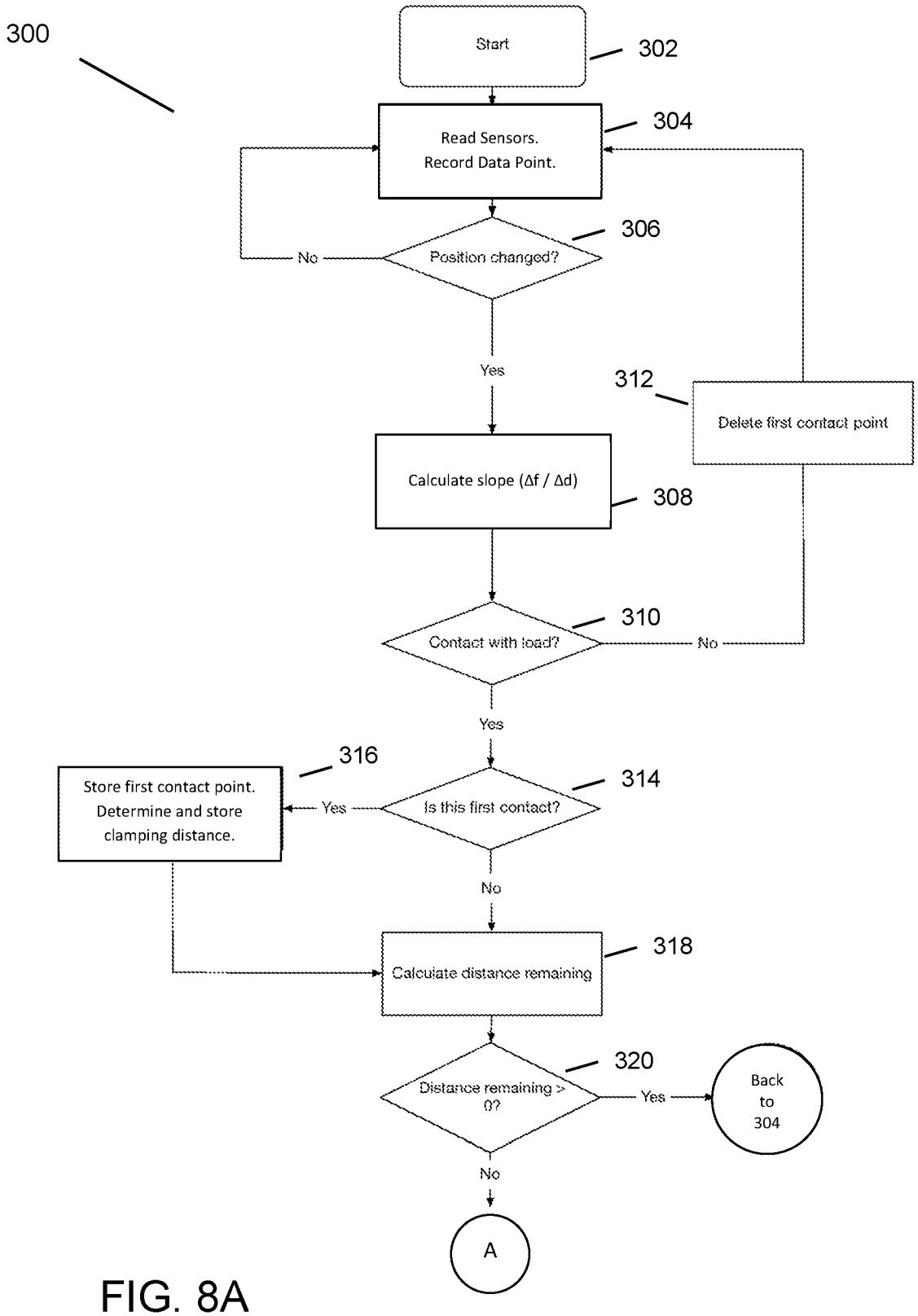
FIGS. 8A and 8B show a flow chart of a method for the electrical controller to control the smart clamp load handler.
Figure 8B:
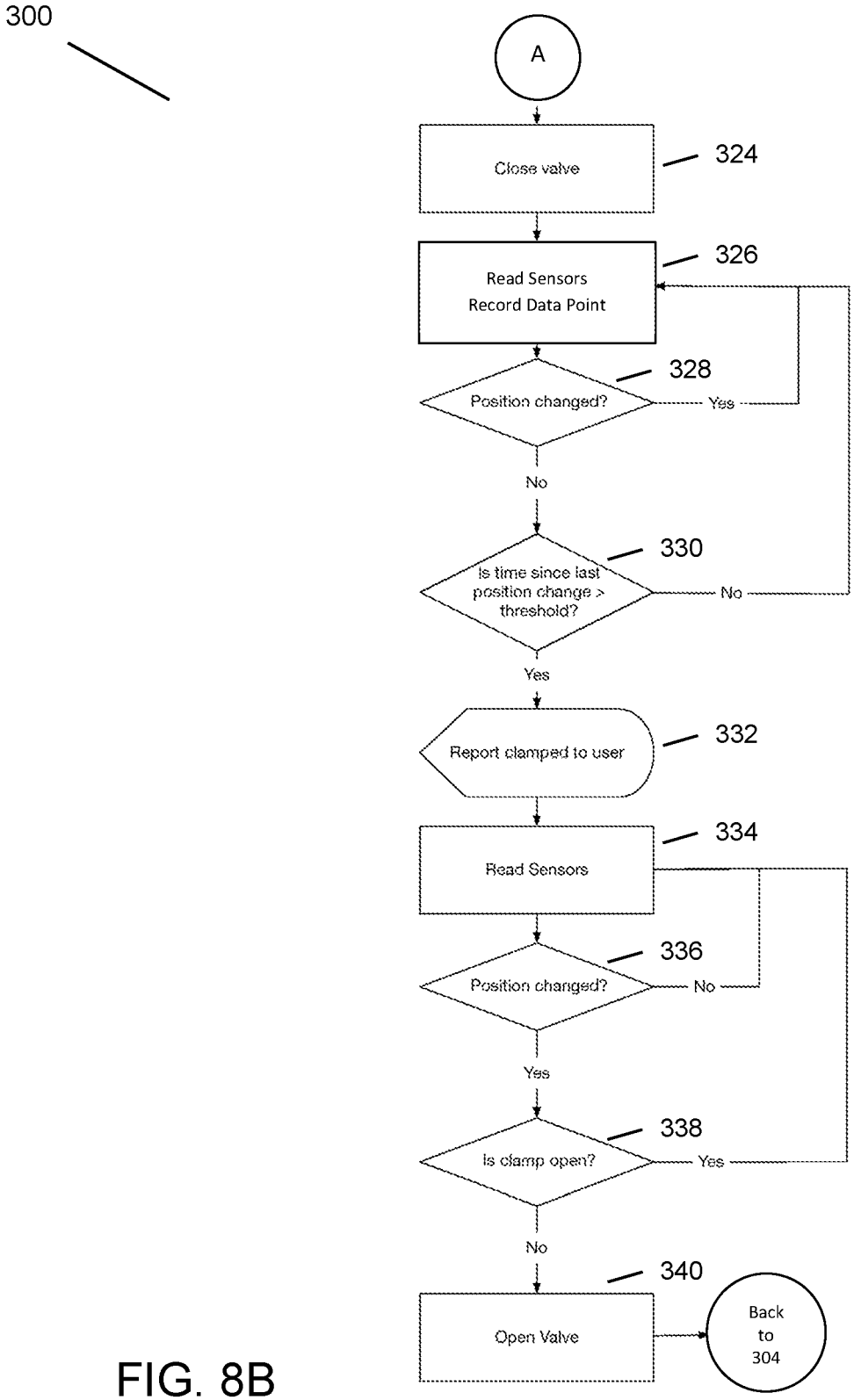

FIGS. 8A and 8B show a flow chart of a method 300 for the electrical controller 120 to control the smart clamp load handler 104. At the start method 300, the system 100 may be fully open as shown in FIG. 4A with the clamp arms 204, 206 open and not in contact with the load 50, fully clamped on the load as shown in FIG. 4D, or any other clamp state. The method 300 starts in step 304 with the electrical controller 120 reading the sensors (rod-side pressure sensor 132, base-side pressure sensor 134, and clamp actuator position sensors 176, 178) and recording these measurements with a time stamp as a data point. The method 300 continues in step 306 with the electrical controller 120 determining if the positions of the clamp arms 204, 206 have changed. If no (the positions have not changed), then the method 300 loops back to step 304. If yes (the positions have changed), then the method 300 proceeds to step 308.

The method 300 continues in step 308 with the electrical controller 120 calculating the change in force applied ($\Delta f$), the change in clamp positions ($\Delta d$), and the force vs distance slope ($\Delta f/\Delta d$) based on the current data point and one or more previous data points. Then step 310 proceeds with the electrical controller 120 determining if the clamp arms 204, 206 are in contact with the load 50 using the calculated force vs distance slope. The criterion for contact is if the force vs distance slope is greater than a slope contact threshold (which itself is greater than zero). If yes (contact made), then the electrical controller 120 proceeds to step 314. If no (contact not made), then the electrical controller 120 proceeds to step 312. In step 312 the electrical controller 120 deletes a first contact point that has been recorded, if any has been recorded yet. This deletion may occur if on a previous iteration of step 210, contact with the load was detected and a first contact point was recorded in step 316, but in a subsequent iteration of step 310, no contact was detected (the previous detection of contact was probably spurious). After execution of step 312, the electrical controller 120 loops back to step 304.

Step 314 has the electrical controller 120 determining if the clamp positions associated with the current data point should be considered to be a first contact point. This is done by checking to see if there is a first contact point recorded. If yes (first contact point recorded), then the electrical controller 120 proceeds to step 316, if no (no first contact point recorded), then the electrical controller 120 proceeds to step 318. In step 316, the electrical controller 120 stores the current data point as the first contact point, calculates and stores the clamping distance. The clamping distance is the additional distance from the position at the first contact point the clamp arms 204, 206 have to close to securely grasp the load 50 so that it can be safely lifted. In the representative embodiment, the clamping distance is determined based on the force vs distance slope at the first contact point ($\Delta f/\Delta d_{fcp}$). The clamping distance is determined by comparing the force vs distance slope at the first contact point to a series of thresholds ($T_{s1}$, $T_{s2}$, $T_{s3}$ . . . ) to obtain the clamping distance from a pre-selected set of value ($D_{c1}$, $D_{c2}$, $D_{c3}$). For example: If $\Delta f/\Delta d_{fcp}$ is greater than $T_{s1}$ but less than $T_{s2}$, then the clamping distance is $D_{c1}$. If $\Delta f/\Delta d_{fcp}$ is greater than $T_{s2}$ but less than $T_{s3}$, then the clamping distance is $D_{c2}$. If $\Delta f/\Delta d_{fcp}$ is greater than $T_{s3}$, then the clamping distance is $D_{c3}$. In other embodiments, other methods of determining clamping distance may be used, with more or fewer thresholds, or based on additional or different data. After completion of step 316, the electrical controller 120 proceeds to step 318

The method 300 continues in step 318 with the electrical controller 120 calculating the distance remaining value. The distance remaining value is calculated by taking the clamping distance and subtracting the difference between the position at first contact and the current position. In some embodiments, the clamping distance is re-calculated based on the current force vs distance slope prior to calculating the distance remaining value.

Next, step 320 has the electrical controller 120 determining if the distance remaining value is greater than zero. If yes (distance remaining value>0), then the method 300 continues by looping back to step 304. If no (distance remaining value≤0), then the method 300 continues with step 324.

In step 324, the electrical controller 120 continues by closing the smart clamp control valve 130, cutting off high pressure hydraulic fluid from the hydraulic pump 106 to the main rod-side hydraulic line 148. The electrical controller 120 does this by cutting off power to the solenoid of the smart clamp control valve 130. The process of closing the smart clamp control valve 130 takes a finite amount of time to accomplish, so high pressure hydraulic fluid continues to flow to the rod-sed of the clamp actuators 152, 154 for some amount of time. The method 300 continues in step 326 with the electrical controller 120 reading the sensors and recording data points, similar to step 304. Next, in step 328, the electrical controller 120 determines if the positions of the clamp arms 204, 206 have changed. If yes (the positions have changed), then the method 300 loops back to step 326. If no (the positions have not changed), then the method 300 proceeds to step 330. In step 330, the electrical controller 120 determines if a time since the last position change of the clamp arms 204, 206 is greater than a threshold. If no (the time since the last position change≤threshold), then the method 300 loops back to step 326. If yes (the time since the last position change>threshold), then the method 300 proceeds to step 332. In step 332 has the electrical controller 120 reporting to the lift truck operator in some fashion that the load 50 is clamped and ready to be lifted. This may be accomplished with an indication on the operator interface 174 or in other ways, such as a specific indicator light that is lit in the lift truck 10.

The method 300 continues in step 334 with the electrical controller 120 reading the sensors and recording data points, similar to step 304. Next, in step 336, the electrical controller 120 determines if the positions of the clamp arms 204, 206 have changed. If no (the positions have not changed), then the method 300 loops back to step 334. If yes (the positions have changed), then the method 300 proceeds to step 338. In step 338, the electrical controller 120 determines if the clamp arms 204, 206 has opened more than a threshold amount. This will happen if the lift truck operator puts the directional control valve 128 in a cross-flow position, porting high pressure hydraulic fluid from the hydraulic pump 106 to the main base-side hydraulic line 150. This will cause the actuator pistons 142 to move slightly as they compress the hydraulic fluid in the rod-side hydraulic lines 182, 184 and main rod-side hydraulic line 148. If no (the clamp arms 204, 206 have not opened more than a threshold amount), then the method 300 loops back to step 334. If yes (the clamp arms 204, 206 have opened more than a threshold amount), then the method 300 proceeds to step 340. In step 340, the electrical controller 120 continues by opening the smart clamp control valve 130, allowing hydraulic fluid from main rod-side hydraulic line 148 to connect to the truck hydraulic return line 126 and return to the hydraulic fluid reservoir 138. This will move the clamp arms 204, 205 open and away from the load 50. After step 340, the method 300 loops back to step 304.

What is claimed is:

1. A smart clamp load handler system comprising:

a first clamp arm and a second clamp arm;

a first actuator coupled to the first clamp arm and a second actuator coupled to the second clamp arm, each of the actuators comprising a rod-side chamber configured for closing of the clamp arms when hydraulic fluid is applied to the rod-side chamber, each of the actuators comprising a base-side chamber configured for opening of the clamp arms when hydraulic fluid is applied to the base-side chamber;

a first actuator position sensor configured to provide a series of first actuator position measurements;

a second actuator position sensor configured to provide a series of second actuator position measurements;

a base-side pressure sensor configured to provide a series of base-side pressure measurements;

an actuator control valve configured to control flow of hydraulic fluid to the actuators; and an electrical controller configured for determining when to stop the closing of the clamp arms based on the series of first and second actuator position measurements, and the series of base-side pressure measurements, then signaling the actuator control valve to stop the closing of the clamp.

2. The system of claim 1, further comprising:

a rod-side pressure sensor configured to provide a series of rod-side pressure measurements;

and wherein electrical controller is configured for determining when to stop the closing of the clamp arms based on the series of first and second actuator position measurements, and the series of base-side and rod-side pressure measurements, then signaling the actuator control valve to stop the closing of the clamp arms.

3. The system of claim 2, further comprising:

wherein the actuator control valve is a two-position solenoid operated valve with a flow blocked position and a flow unblocked position.

4. The system of claim 2, further comprising:

a control console coupled communicatively to the electrical controller, the control console configured for displaying one or more of a force applied by the actuators, a distance the clamps have moved, an indication of whether the load is clamped, and an indication whether the load is being over-clamped.

5. The system of claim 2, wherein determining when to stop the closing of the clamp arms is further based on:

a series of data points including a current data point, each data point comprising one of the series of first actuator position measurements, one of the series of second actuator position measurements, one of the series of base-side pressure measurements, one of the series of rod-side pressure measurements and an associated one of a series of a time stamps;

a current force/distance slope based on a current data point and one of the series of data points previously recorded;

a first contact data point set to the current data point if the current force/distance slope is greater than a contact threshold; and a clamping distance based on a force/distance slope associated with the first contact data point.

6. The system of claim 2, wherein the electrical controller is configured for determining when to stop the closing of the clamp arms, then signaling the actuator control valve to stop the closing of the clamp arms by performing the steps of:

(a) reading current measurements from the first actuator position sensor, the second actuator position sensor, the base-side pressure sensor and the rod-side pressure sensor and recording with a current time stamp as a current data point in a series of data points, each data point comprising one of the series of first actuator position measurements, one of the series of second actuator position measurements, one of the series of base-side pressure measurements, one of the series of rod-side pressure measurements and one of a series of a time stamps;

(b) calculating a clamp force currently applied by the actuators, calculating a change in a clamp force, calculating a change in actuator positions, and calculating a current force/distance slope, each based on the current data point and one of the series of data points previously recorded;

(c) determining that contact with the load between the clamp arms has been detected if the current force/distance slope is greater than a contact threshold;

(d) setting the current data point as a first contact data point and calculating a clamping distance based on the current force/distance slope if there is no first contact data point currently set and contact with the load has been detected at the current data point;

(e) calculating a distance remaining value based on the clamping distance, the first contact data point and the current data point; and (f) signaling the actuator control valve to stop the closing of the clamp arms if the distance remaining value equal to or less than a distance remaining threshold.

7. The system of claim 6, wherein the step of (b) calculating the clamp force comprises the steps of:

(b)(1) calculating a rod-side force by multiplying rod-side pressure by a difference of an area of each piston of the actuators less an area of each rod of the actuators;

(b)(2) calculating a base-side force by multiplying base-side pressure by the area of each piston of the actuators; and (b)(3) subtracting the base-side force from the rod-side force.

8. The system of claim 6, wherein the electrical controller is further configured for determining when to stop the closing of the clamp arms, then signaling the actuator control valve to stop the closing of the clamp arms by performing the steps of:

(a)(a) after performing step (a), looping back to step (a) if the actuator position measurements of the current data point are unchanged from a most recent previously recorded data point of the series of data points;

(d)(a) after performing step (d), deleting the first contact data point if there is no contact has been detected at the current data point and looping back to step (a); and (f)(a) after performing step (f), looping back to step (a) if the distance remaining value is greater than the distance remaining threshold.

9. The system of claim 8, wherein the electrical controller is further configured for determining when to stop the closing of the clamp arms and configured for then signaling the actuator control valve to stop the closing of the clamp arms by performing the step of:

(d)(b) after performing step (d)(a), re-calculating the clamping distance based on the current force/distance slope prior to calculating the distance remaining value.

10. The system of claim 6, wherein clamping distance is calculated by comparing the current force/distance slope to a table of force/distance slope thresholds and associated clamping distance values.

11. The system of claim 6, wherein the electrical controller is further configured for determining when to stop the closing of the clamp arms, then signaling the actuator control valve to stop the closing of the clamp arms by performing the steps of:

(g) reading the current measurements from the first actuator position sensor, the second actuator position sensor, the base-side pressure sensor and the rod-side pressure sensor and recording with the current time stamp as the current data point in the series of data points;

(h) looping back to step (g) if the actuator position measurements of the current data point are unchanged from a most recent previously recorded data point of the series of data points;

(i) looping back to step (g) if a time since the actuator position measurements have changed is less than or equal to a stop time threshold; and (j) indicating to a lift truck operator that the load is clamped and ready to be lifted.

12. The system of claim 6, further comprising:

a control console communicatively coupled with the electrical controller and configured to display one or more of the pressure measurements, the actuator position measurements, and the clamp force.

13. A method for an electrical controller of a smart clamp load handler of a lift truck with first and second clamp arms configured to be moved by first and second actuators, each of the actuators comprising a rod-side chamber configured for closing of the clamp arms when hydraulic fluid is applied to the rod-side chamber, comprising the steps of:

(1) reading measurements from sensors, including a base-side pressure sensor providing a series of base-side pressure measurements, a first actuator position sensor providing a series of first actuator position measurements, a second actuator position sensor providing a series of second actuator position measurements;

(2) recording the measurements in a series of data points, each data point comprising one of the series of first actuator position measurements, one of the series of second actuator position measurements, one of the series of base-side pressure measurements, and an associated one of a series of a time stamps; and (3) determining when to stop the closing of the clamp arms based on the series of first and second actuator position measurements, and the series of base-side pressure measurements, then signaling an actuator control valve to stop the closing of the clamp arms.

14. The method of claim 13, wherein the step of (3) determining when to stop the closing of the clamp arms, then signaling the actuator control valve to stop the closing of the clamp arms comprises the steps of:

(a) reading current measurements from the sensors and recording with a current time stamp as a current data point in the series of data points;

(b) calculating a clamp force currently applied by the actuators, a change in a clamp force and a change in actuator positions, a current force/distance slope based on the current data point and one of the series of data points previously recorded;

(c) determining that contact with a load between the clamp arms has been detected if the current force/distance slope is greater than a contact threshold;

(d) setting the current data point as a first contact data point and calculating a clamping distance based on the current force/distance slope if there is no first contact data point currently set and contact with the load has been detected at the current data point;

(e) calculating a distance remaining value based on the clamping distance, the first contact data point and the current data point; and (f) signaling the actuator control valve to stop the closing of the clamp arms if the distance remaining value equal to or less than a distance remaining threshold.

15. The method of claim 14, wherein the step of (b) calculating the clamp force comprises the steps of:

(b)(1) calculating a rod-side force by multiplying rod-side pressure by a difference of an area of each piston of the actuators less an area of each rod of the actuators;

(b)(2) calculating a base-side force by multiplying base-side pressure by the area of each piston of the actuators; and (b)(3) subtracting the base-side force from the rod-side force.

16. The method of claim 14, wherein the step of (c) determining when to stop the closing of the clamp arms, then signaling the actuator control valve to stop the closing of the clamp arms further comprises the steps of:

(a)(a) after performing step (a), looping back to step (a) if the actuator position measurements of the current data point are unchanged from a most recent previously recorded data point of the series of data points;

(d)(a) after performing step (d), deleting the first contact data point if there is no contact has been detected at the current data point and looping back to step (a); and (f)(a) after performing step (f), looping back to step (a) if the distance remaining value is greater than the distance remaining threshold.

17. The method of claim 16, wherein the step of (3) determining when to stop the closing of the clamp arms, then signaling the actuator control valve to stop the closing of the clamp arms includes the steps of:

(d)(b) after performing step (d)(a), re-calculating the clamping distance based on the current force/distance slope prior to calculating the distance remaining value.

18. The method of claim 14, wherein the clamping distance is determined by comparing the current force/distance slope to a table of force/distance slope thresholds and associated clamping distance values.

19. The method of claim 14, wherein the step of (3) determining when to stop the closing of the clamp arms, then signaling the actuator control valve to stop the closing of the clamp arms further comprises the steps of:

(g) reading the current measurements from the sensors and recording with the current time stamp as the current data point in the series of data points;

(h) looping back to step (g) if the actuator position measurements of the current data point are unchanged from a most recent previously recorded data point of the series of data points;

(i) looping back to step (g) if a time since the actuator position measurements have changed is less than or equal to a stop time threshold; and (j) indicating to a lift truck operator that the load is clamped and ready to be lifted.

20. A smart clamp load handler system comprising:

a first clamp arm and a second clamp arm;

a first actuator and a second actuator, each of the actuators comprising a rod-side chamber configured for closing of the clamp arms when hydraulic fluid is applied to the rod-side chamber, each of the actuators comprising a base-side chamber configured for opening of the clamp arms when hydraulic fluid is applied to the base-side chamber;

a distance sensor configured to measure a distance between the first and second clamp arms and provide a series of distance measurements;

a rod-side pressure sensor configured to provide a series of rod-side pressure measurements;

a base-side pressure sensor configured to provide a series of base-side pressure measurements;

an actuator control valve configured to control flow of hydraulic fluid to the actuators; and an electrical controller configured for determining when to stop the closing of the clamp arms based on the series of distance measurements, and the series of base-side and rod-side pressure measurements, then signaling the actuator control valve to stop the closing of the clamp arms.

* * * * *